United States Patent [19]

Laskey

[11] 4,169,423

[45] Oct. 2, 1979

[54] MARINE SHUNTER

[76] Inventor: Norman V. Laskey, 264 Bromley Ave., St. Lambert, Chambly County, Quebec, Canada

[21] Appl. No.: 836,764

[22] Filed: Sep. 26, 1977

Related U.S. Application Data

[63] Continuation of Ser. No. 711,364, Aug. 3, 1976, abandoned.

[30] Foreign Application Priority Data

Aug. 8, 1975 [GB] United Kingdom ..... 33158/75

[51] Int. Cl.[2] ..... B63B 21/56

[52] U.S. Cl. ..... 114/248; 114/151; 114/251; 115/16

[58] Field of Search ..... 114/242, 246, 247, 248, 114/249, 250, 251, 151, 219; 115/16

[56] References Cited

U.S. PATENT DOCUMENTS

| | | | |
|---|---|---|---|
| 3,098,464 | 7/1963 | Holland | 115/16 |
| 3,169,756 | 2/1965 | Miller | 114/219 X |
| 3,645,225 | 2/1972 | Lunde | 114/253 X |
| 3,698,349 | 10/1972 | Stevens | 114/249 |
| 3,892,195 | 7/1975 | Janssen | 114/249 |

*Primary Examiner*—Trygve M. Blix
*Assistant Examiner*—Sherman D. Basinger
*Attorney, Agent, or Firm*—McFadden, Fincham & Co.

[57] ABSTRACT

The present invention relates to a navigational system and in particular, provides for the use of one or more vessels as shunters for maneuvering larger vessels in restricted waterways, each shunter comprising a body portion, a pair of clamping arms with each arm being pivotably connected at one end thereof to the body of the shunter with the opposed end of each arm being adapted to engage the hull of the vessel to be maneuvered to thereby exert a lateral force on the hull. Preferably, hydraulic jet thrusters are employed for powering the shunters and the shunter and the vessel to be maneuvered are inter-connected by mooring lines.

12 Claims, 6 Drawing Figures

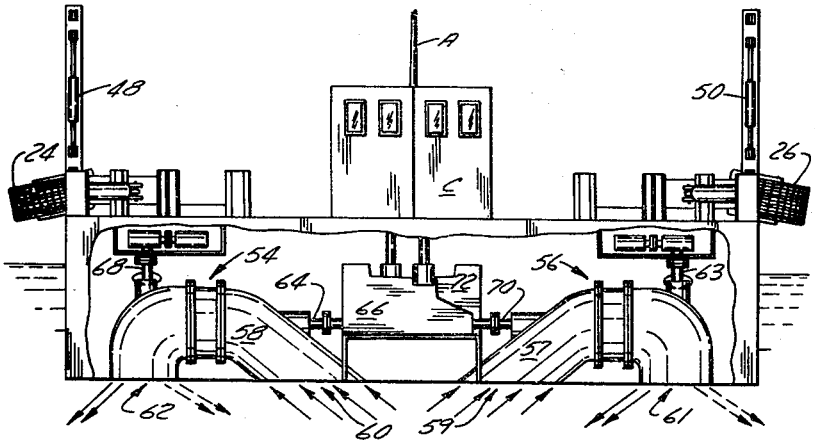
FIG. 4
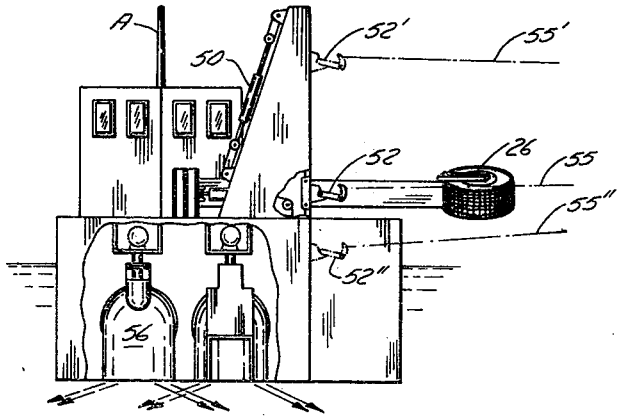
FIG. 5
FIG. 6
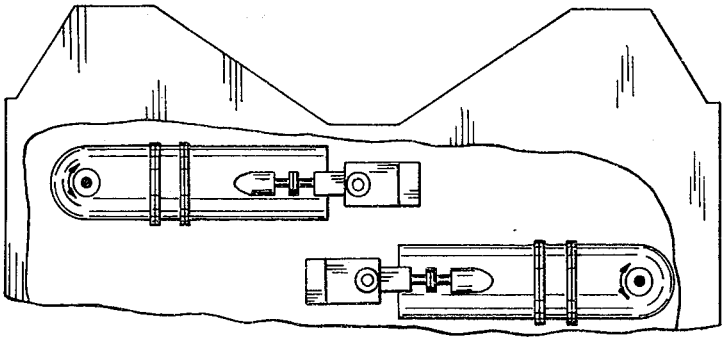

MARINE SHUNTER

This is a continuation application of Ser. No. 711,364 filed Aug. 3, 1976, which application is now abandoned.

The present invention relates to a navigational system, and more particularly to the use of novel "shunters" or self-propelled pontoons.

In restricted waterways, hull damage to vessels utilizing the waterway is an all too frequent occurrence. Normally, such vessels are relatively large and are very limited in their maneuverability. In this respect, the term "restricted waterways" refers to any waterway or portion thereof wherein the maneuverability of the vessel is somewhat restricted. This may include, for example, canals, locks, rivers, harbours, channels, etc.

In the prior art, large vessels have traditionally employed their own propulsion equipment for maneuvering in locks and channels. However, the possibility of error in human judgment is always present and has resulted in the aforementioned hull damage to vessels. Also, damage to surrounding equipment such as lock gates has occurred resulting in a blockage of the restricted waterway for a considerable period of time until the equipment can be repaired.

Alternatively, where sufficient room is provided, the use of "tugs" is well known in the art. Basically, these tugs are constructed along the lines of a conventional vessel; the tugs being much smaller and more powerful in terms of their power/weight ratio. Conventionally, such tugs either pull or push the vessel to be maneuvered; however, in some restricted locations such as locks, the use of tugs is not suitable.

It is therefore an object of the present invention to provide a system for use with vessels in restricted waterways reducing the hazard of hull damage to vessels employing the waterway.

It is a further object of the present invention to provide a vessel having the capability of maneuvering many different types of larger vessels rapidly and efficiently.

According to one aspect of the present invention, there is provided a shunter for use in maneuvering vessels in restricted waterways, the shunter comprising a body portion, a pair of hull clamping arms, said arms being pivotably connected proximate one end thereof to the body portion, the opposed ends of said arms being adapted to engage the hull of the vessel to be maneuvered, means for powering the shunter, and means for securing said shunter to the vessel to be maneuvered.

As used herein, the term "shunter" denotes a vessel constructed according to the teachings of the present invention. The shunter is employed for the purposes of maneuvering larger vessels in restricted waterways.

Preferably, the body or hull of the shunter comprises a pair of sponsons suitably secured together. The basic geometry of the shunter does not embody a conventional ship-shaped hull form, but rather, assumes a somewhat rectangular configuration with a notch in one end thereof to accommodate the bow or stern of the vessel to be maneuvered.

The shunter includes drive means for powering the vessel and to this end, in a preferred embodiment, hydraulic jet thrusters are employed. Preferably, each shunter has two such hydraulic jet thrusters. Each hydraulic jet thruster includes a body having a conduit extending throughout, an inlet, an outlet, a rotor, means for driving the rotor, an outlet deflector, and means for rotating the outlet deflector through 360 degrees. The outlet deflector is preferably arranged such that the water discharge is substantially in a horizontal plane. Means are provided for rotating the discharge deflector to the desired position and accordingly, the direction of discharge is controllable to control the direction of thrust imparted to the shunter. Conveniently, the jet thruster may be driven by conventional means such as, for example, a diesel engine. The amount of thrust developed will vary and may, for example, be in the order of 6 long tons which, when considering that there are a minimum of two such jet thrusters, means that a combined static thrust of 12 tons is available to each shunter.

Each shunter includes a pair of "hull clamping arms" which are adapted to engage the sides of the hull of the vessel to be maneuvered. To this end, each clamping arm is pivotably mounted, one end thereof, to the shunter. At the end contacting the ship hull, there may be provided pneumatic fenders for reasons which will become apparent hereinafter.

The shunter also includes means for "inter-connecting" the shunter and vessel. Conveniently, the means may comprise tow hooks on the shunter to which are secured mooring or tow lines thus inter-connecting the vessel and shunter. Preferably, the mooring or tow lines are located at a level coinciding with the horizontal center line of the hull clamping arms. To assure the above orientation and for other reasons discussed hereinbelow, the tow hooks on the shunter are preferably movable in a vertical plane. By so doing, the couple produced by the thrust of the hydraulic jet thrusters is counteracted.

Although only one shunter may be employed in maneuvering a vessel, preferably a pair of such shunters are employed, one at the bow and the other at the stern of the vessel. When employed for handling a barge, the wide end of the shunter permits simple connection to the square end of a barge and when a barge train comprising a number of barges is assembled, a shunter attached to either end will provide much superior maneuverability than a pusher tug at one end only as is conventional in the art. Increments of power for larger barge train handling can be obtained by first connecting the requisite numbers of shunters together before attachment to the barge train.

The bottom of the shunter may be flat, and since there are no underwater appendages such as a rudder and propeller, the shunter can safely operate in shallow water. Furthermore, use of the propulsion equipment of the vessel being maneuvered may be employed.

If so desired, the hull clamping arms may be equipped with means other than the pneumatic fenders. For example, a fender of a magnetic material may be employed which comprises a plurality of "small" magnets enabling contact to be achieved over the entire working surface of the magnet so as to fit the hull geometry of the ship.

The shunter may be remotely controlled by radio, if so desired, for certain operations.

In an automatic mode, the shunters may be computerized. For example, in a waterway such as a canal, a number of shore-based stations may be placed thereabelong emitting pulse transmissions in the X-band. A microcomputer then may be employed to convert the basic navigational data to a visual record on a left-right indicator.

Having thus generally described the invention, reference will be made to the accompanying drawings, illustrating an embodiment thereof, in which FIG. 1 is a plan view of a vessel and associated shunters in a lock;

FIG. 4 is an end elevational view, partially in section, of the shunter of FIG. 3;

FIG. 5 is a side elevational view, also partially in section, of the shunter unit of FIGS. 3 and 4; and FIG. 6 is a top elevational view, partially in section, of a portion of a shunter unit.

Figure 1:
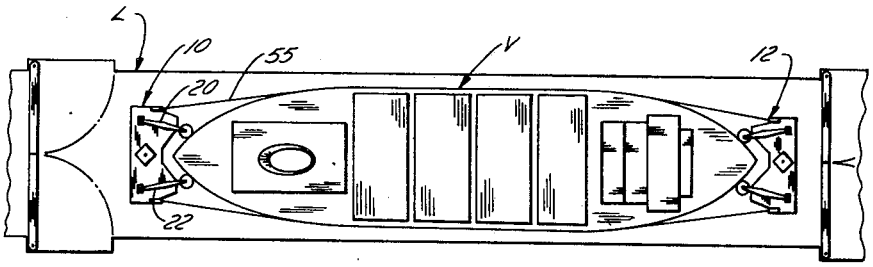

Referring to the drawings in greater detail and by reference characters thereto, there is illustrated in FIG. 1 a vessel V in lock L having shunter units 10 and 12 attached to the stern and bow respectively of the vessel.

In FIGS. 3 to 6, shunter 10 will be described in greater detail; in this respect, it will be understood that shunter 12 is of an essentially identical construction as will become apparent hereinafter.

Figure 3:
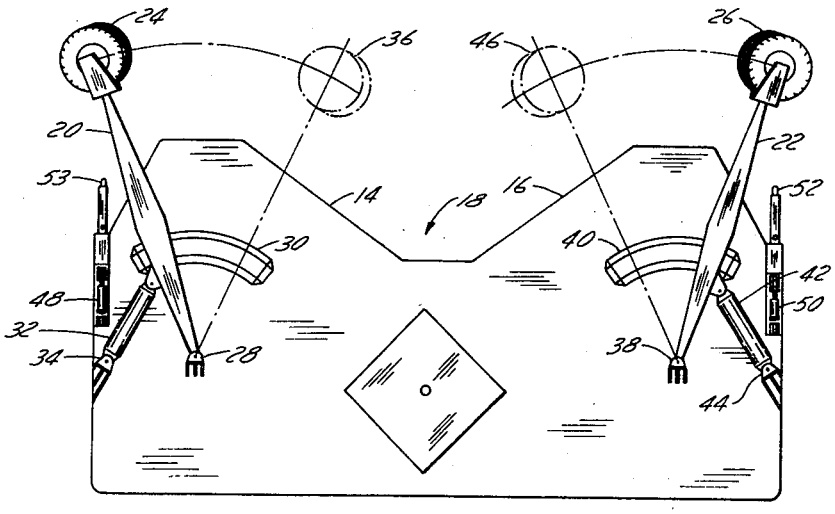
FIG. 3 is a top plan view of a shunter unit according to one embodiment of the invention.

As illustrated in FIG. 3, shunter 10 has a generally overall rectangular configuration in its top plan view with converging walls 14 and 16 forming a "notch" 18 in the end juxtaposed to the stern of the vessel. Shunter 10 includes a pair of hull clamping arms 20 and 22, each arm having at one end thereof a pneumatic fender designated by reference numerals 24 and 26 respectively. Shunter 10 may be formed of a pair of sponsons suitably secured together to form the desired notch 18.

In greater detail, as may be seen from FIG. 3, hull clamping arm 20 is pivotably secured to the shunter at fulcrum 28 whereby arm 20 is movable in an arc from its initial position to a position designated by reference number 36. A support roller and track 30 are provided on which arm 20 rides; arm 20 is driven by a suitable hydraulic cylinder 32 secured to the shunter at fulcrum 34.

Similarly, clamping arm 22 is pivotably secured at fulcrum 38 and is movable on track 40 through use of a hydraulic cylinder 42 secured to the shunter at fulcrum 44. Thus, hull clamping arm 22 may be moved from its extreme outer position as shown and described to the position indicated by reference numeral 46.

Shunter 10 also includes means for securing the shunter unit to the vessel to be maneuvered. To this end, there are provided, at the sides thereof, towing hooks 53 and 52. Towing hooks 53 and 52 are movable in a vertical direction; as shown in the drawings, each hook 53 and 52 has associated therewith a hydraulic cylinder 48 and 50 respectively, for moving the towing hooks to the desired position.

The drive means for shunter 10 comprises a pair of hydraulic jet thrusters 54 and 56. As may be seen from FIG. 4, jet thruster 54 includes a conduit 58 having an inlet 60 and a discharge 62. Mounted within conduit 58 is a rotor (not shown) to draw water in inlet 60 and discharge the same through outlet 62. The jet thruster may further include static guide vanes and, positioned at discharge 62, a discharge deflector which is rotatable through 360°. To this end, a shaft 68 connected to the discharge deflector is provided.

A power plant comprising a diesel engine 66 is operatively coupled to drive shaft 64 for driving the rotor.

Hydraulic jet thruster 56 is of a substantially identical construction as above described and thus includes an internal conduit 57, an inlet 59, an outlet 61, a rotor and discharge deflector (not shown), a drive shaft 70 coupled to power source 72, and a steering shaft 63.

As previously indicated, each of the hydraulic jet thrusters has a discharge deflector which is rotatable through 360° and thus the direction of discharge of the water may be controlled and accordingly, the direction of thrust is controlled. Naturally, if so desired, the same power source may be utilized for both hydraulic jet thrusters.

The shunter, in the illustrated embodiment, includes a cabin C with a omni-directional antenna A mounted thereon.

The above-described hydraulic jet thrusters are thus, in essence, a large axial flow pump including a rotor and static guide vanes in the housing. By means of a system of rotatable deflectors at the discharge portion, a relatively flat jet of water emerges in a horizontal plane and through the use of the steering shaft, these deflectors can be rotated through a range of 360 degrees. Assuming each thruster is capable of developing a static thrust of six long tons, each end of the vessel will thus be controlled in a precise manner by a combined static thrust of twelve tons while a total instantaneous static thrust of twenty-four long tons will be available for rapidly accelerating, retarding, rotating and maneuvering the vessel when under the control of two shunters. Employing such a hydraulic jet thruster in shunters according to the present invention, a typical vessel such as is employed in inland waterways travelling at a speed of 153.72 feet per minute can be brought to a stationary condition over a distance of 86.23 feet in 77.67 seconds.

The prime mover or power plant driving each thruster may be any suitable and in one embodiment, a diesel engine can be utilized to drive each hydraulic jet thruster. In this embodiment, a speed reducing gear box with clutch and a torsional vibration damper cum flexible coupling can be interposed between the diesel engine and jet thruster.

The hull clamping arms 20 and 22 may also be driven by any suitable means and in this respect, in one embodiment, each hull clamping arm may be driven by a diesel alternator for powering a pair of electro-hydraulic pumps which will then serve the hull clamping arms and as well, can be used for adjusting the vertical location of the towing hooks and other electrically driven associated machinery and equipment.

The pneumatic fenders on the hull clamping arms prevent lateral movement of the shunter relative to the vessel while maintaining a clearance between the apex 18 of the shunter and the bow or stern of the vessel as appropriate. The arms locate the shunter along the fore and aft centerline of the vessel and absorb all lateral thrust imparted to the bow or stern to maneuver a ship laterally. In a typical embodiment, a lateral force can be exerted on the hull by the pneumatic fender ranging from twenty-nine tons at their extreme open position to fifteen tons at the extreme closed position. Since, as aforementioned, in a preferred embodiment each shunter employs hydraulic jet thrusters having a combined static thrust of twelve tons, the lateral load to be absorbed by the hull clamping arms will not exceed its clamping capabilities regardless of the geometry of the bow or stern of the vessel being handled.

The steering shaft of the hydraulic jet thrusters may conveniently be driven by an electric motor in association with a speed reducer whereby the steering spindle could be turned through 180 degrees in a matter of a couple of seconds.

In the preferred embodiment, the shunters are provided with microcomputers for the purpose of converting basic navigational data to a visual record on a left-right indicator so that the operators of the shunters can place the vessel they are handling on a predetermined track coinciding with the fore and aft centerline of the waterway. For example, a number of shore based stations may be employed along stretches of the waterway with additional stations at critical locations such as the entries and exits of locks and the like. The location of the shunter relative to two fixed points may easily be established by pulse transmissions in the X-band from the shore based stations as is well known in the art.

In operation, the shunter is propelled towards the bow or stern of the vessel to be handled with the hull clamping arms spread apart. When the bow or stern is proximate the apex of the towing notch, the hull clamping arms are closed to permit the pneumatic fenders to make contact with the hull on the port and starboard sides. As aforementioned, depending on the exact geometry of the hull clamping arms and the hydraulic cylinder actuating the same, a lateral force can be exerted on the hull by the pneumatic fender from twenty-nine tons at the extreme open position to fifteen tons at the extreme closed position.

The mooring or towing lines are subsequently connected on each side of the vessel to the towing hooks of the shunter; reference may be had to FIG. 5 wherein a mooring line 55 is connected to hook 52. These mooring lines may then be tensioned by shipboard winches to produce a pull of, for example, eight tons on each line. These mooring lines will be located approximately at a level coinciding with the horizontal centerline of the hull clamping arms through use of the movable hooks. Thus, as indicated in FIG. 5, hooks may be movable through hydraulic cylinder 52 to the positions indicated by reference numerals 52' and 52''.

If, for example, the shunter is attached to the bow for purpose of moving the vessel ahead, the thrust developed by the hydraulic jet thrusters will produce a couple tending to rotate the shunter in an anticlockwise position about the point of contact between the pneumatic fender at the end of each hull clamping arm and the hull. To counteract this, a clockwise couple is introduced by moving the towing hooks to a desired position. In this respect, a trim indicator may be provided for the operator of the shunter and depending on the thrust developed at any instant, vertical location of the towing hooks may be adjusted so that the clockwise couple produced by the tension in the mooring lines balances the anticlockwise couple produced by the thrust developed by the jet thrusters.

Furthermore, if the shunter is attached to the stern for purpose of moving the vessel ahead, the thrust of the jet thrusters will produce a couple tending to rotate the shunter in an anticlockwise position about the point of contact between the pneumatic fender at the end of each hull clamping arm and in the hull. Again, the towing hooks may be vertically adjusted as was discussed with respect to the attachment of the shunter to the bow thereby counteracting this couple.

To ensure that equal tension is present in each of the two mooring lines employed in attaching a shunter to the bow/stern of the vessel, a pressure transmitter type TRG may be incorporated in a permanently installed air line along the hull clamping arm for inflating each pneumatic fender. The function of the TRG unit is predicated on inductive conversion of movement induced in a Bourdon Tube within it to an electric signal. Assuming that the pneumatic fender is inflated to a pressure 3.515 kg/cm$^2$ and then placed in contact with the shell of the vessel, deformation will cause a change in the pressure in the air line on each hull clamping arm serving the pneumatic fender. This will be recorded on an indicator. When the mooring lines were touching the shunter to the vessel tension, additional deformation of the fender will occur causing a further increase in air pressure in the air line serving the pneumatic fender. This will also be recorded on the indicator and thereby, a qualitative assessment of the tension in each mooring line is readily obtained. Thus, the winches aboard the vessel will only be required to tension the mooring wire or line to a predetermined amount to hold the shunter to the vessel after which the brake is applied. This obviates the problem in the prior art which is experienced with many vessels since their mooring winches have a low light line speed while, if they are of the automatic tension type, the stall and render loads for which they are designed are inappropriate for arresting the vessel in a lock.

Figure 2:
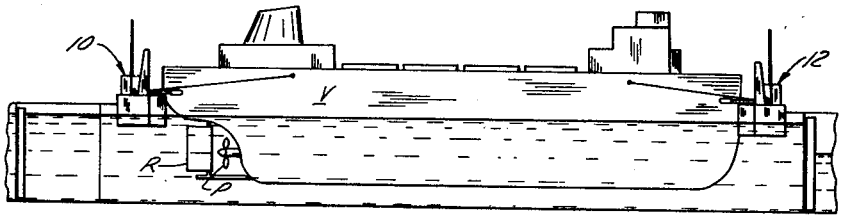
FIG. 2 is a side elevational view of FIG. 1.

During the use of the shunters, the ship's propulsion equipment will normally not be used but will be maintained in a stand-by condition. The draft of the shunter is relatively small being, for example, six feet or less. As may be seen from FIG. 2, the small draft leaves the ship's rudder R and prop P free such that, should the occasion require the same, the ship's propulsion equipment can be used at any moment. Furthermore, as the bottom of the shunter is flat and there are no underwater appendages such as a rudder and propeller, the shunter can safely operate in shallow water.

If so desired, the operation of the shunters may be substantially automated and controlled from shore stations. Each shunter may employ a crew of two people and through the use of the automatic control system, in conjunction with the shore based stations, the vessel will be operable under weather conditions which would otherwise not permit navigation.

It will be understood that the above description is that of a preferred embodiment only and changes and modifications may be made thereto without departing from the spirit and scope of the invention.

I claim:

1. A shunter for use in maneuvering vessels in restricted waterways, the shunter comprising a body portion, a pair of clamping arms, said arms being pivotably connected proximate one end thereof to opposite sides of the body portion of the shunter with the opposed ends of said arms being adapted to engage opposed sides of the hull of the vessel to be maneuvered, means for moving said clamping arms into and out of a hull engaging relationship with said hull sides, said means being capable of exerting a substantial lateral force on each of the hull sides, drive means for powering the shunter, and means for interconnecting the shunter to the vessel to be maneuvered.

2. The shunter of claim 1 wherein said body portion comprises a pair of sponsons, said sponsons being interconnected to form a notch in one end of said shunter adapted to receive the bow or stern of the vessel to be maneuvered.

3. The shunter of claim 1 wherein said means for interconnecting said shunter to the vessel to be maneuvered comprises a pair of towing hooks mounted on said shunter for receiving mooring lines, means for vertically moving said towing hooks to a level coinciding with the horizontal centerline of said clamping arms.

4. The shunter of claim 3 wherein each of said clamping arms is actuated by a hydraulic cylinder.

5. The shunter of claim 1 wherein each of said hull clamping arms has a pneumatic fender on the end adapted to engage the hull of the vessel to be maneuvered and said means for moving said clamping arms comprises hydraulic cylinders associated with said arms to impart the lateral force to the hull sides and to absorb lateral thrust.

6. The shunter of claim 5 wherein said means for securing the vessel to the shunter comprises a pair of towing hooks, each adapted to receive a mooring line from opposed sides of the vessel.

7. The shunter of claim 6 further including means for vertically moving the position of said towing hooks to a level coinciding with the horizontal centerline of said clamping arms.

8. The shunter of claim 5 wherein said drive means for powering said shunter comprises a pair of hydraulic jet thrusters.

9. The shunter of claim 8 wherein each hydraulic jet thruster comprises a housing, an inlet, a discharge rotor means for drawing in water through the housing, a discharge deflector rotatable through 360 degrees, and means for rotating said discharge deflector to a desired position.

10. The shunter of claim 5 wherein each of said clamping arms is adapted to exert a lateral force on the hull of the vessel of between 15 and 29 tons.

11. The shunter of claim 1 wherein each of said hull clamping arms includes a pneumatic fender on the end adapted to engage the hull of the vessel to be maneuvered, means for interconnecting mooring lines between the shunter and vessel, means for tensioning the mooring lines, and means for measuring any deformation of said pneumatic fenders.

12. A system for use in restricted waterways for maneuvering large vessels comprising a pair of shunters, each shunter having a body portion, a pair of clamping arms, each of said arms being pivotably connected proximate one end thereof to opposite sides of the body portion of the shunter with the opposed ends of said arms being adapted to engage opposed sides of the hull of the vessel to be maneuvered, means for moving said clamping arms into and out of a hull engaging relationship with said hull sides, said means being capable of exerting a lateral force on the hull sides, drive means rotatable through 360° for powering each shunter, and means for inter-connecting each shunter to the vessel to be maneuvered, each shunter having a notch formed in one end thereof, a first one of said shunters being positioned at the bow of the vessel to be maneuvered, and a second one of said shunters being positioned at the stern of the vessel to be maneuvered.

* * * * *